US008387264B1

(12) United States Patent
Pritchard

(10) Patent No.: US 8,387,264 B1
(45) Date of Patent: Mar. 5, 2013

(54) ALUMINUM CAN PUNCTURING DEVICE

(76) Inventor: Kyle Pritchard, Brampton (CA)

( * ) Notice: Subject to any disclaimer, the term of this patent is extended or adjusted under 35 U.S.C. 154(b) by 275 days.

(21) Appl. No.: 12/861,873

(22) Filed: Aug. 24, 2010

(51) Int. Cl.
*B26F 1/32* (2006.01)

(52) U.S. Cl. ..... 30/366; 30/315; 30/443

(58) Field of Classification Search ..... 30/314, 30/315, 358, 366, 367, 368, 443
See application file for complete search history.

(56) References Cited

U.S. PATENT DOCUMENTS

| | | | | | |
|---|---|---|---|---|---|
| 497,698 | A | * | 5/1893 | Weston | 30/443 |
| 1,689,047 | A | * | 10/1928 | Packer | 30/366 |
| 2,338,592 | A | * | 1/1944 | Lorenzen | 30/443 |
| 2,390,309 | A | | 12/1945 | Keys | |
| 2,522,777 | A | | 9/1950 | Butt et al. | |
| 2,620,558 | A | * | 12/1952 | Bergeron | 30/443 |
| 2,943,389 | A | | 7/1960 | Dubois | |
| 3,349,821 | A | * | 10/1967 | Moeller | 99/646 R |
| 3,859,726 | A | * | 1/1975 | Mitsunari | 30/358 |
| D292,770 | S | | 11/1987 | Scurto | |
| 5,791,056 | A | * | 8/1998 | Messina | 30/361 |
| 6,394,518 | B1 | * | 5/2002 | Kelley | 294/61 |
| 6,629,483 | B2 | * | 10/2003 | Iwao | 83/866 |
| 6,874,237 | B2 | * | 4/2005 | Robitaille | 30/316 |
| 7,503,120 | B2 | | 3/2009 | Williams | |
| 2004/0016330 | A1 | * | 1/2004 | McCarty et al. | 83/13 |
| 2006/0117577 | A1 | | 6/2006 | King | |
| 2006/0236552 | A1 | * | 10/2006 | Giles | 30/366 |

* cited by examiner

*Primary Examiner* — Hwei C Payer
(74) *Attorney, Agent, or Firm* — Kyle Fletcher, Esq.

(57) ABSTRACT

The aluminum can puncturing device is a hand-held device that resembles a shot gun shell and of which is capable of puncturing an air vent into a side of an aluminum can in order to "shotgun" a beer. The aluminum can puncturing device includes a spring-loaded pin that retracts within a shotgun shell. The aluminum can puncturing device is placed onto an outer surface of an aluminum can and pushed thereon in order to extend the pin out from under the shotgun shell in order to pierce a vent hole into the aluminum can.

6 Claims, 3 Drawing Sheets

ALUMINUM CAN PUNCTURING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of aluminum can puncturing devices, more specifically, a can puncturing device that is spring-loaded and resembles a shotgun shell.

B. Discussion of the Prior Art

As will be discussed immediately below, no prior art discloses an aluminum can puncturing device that is directed to use in puncturing an air vent in an aluminum can of beer for use in "shot-gunning" a can of beer or chugging the entire contents of said beer can; wherein the device resembles a shotgun shell and includes a spring-loaded pin for use in puncturing the can of beer.

The Dubois Patent (U.S. Pat. No. 2,943,389) discloses a spring loaded punch for perforating aluminum cans. However, the punch does not resemble a shotgun shell for use in creating an air vent to enable an end user to "shotgun" a can of beer.

The Butt et al. Patent (U.S. Pat. No. 2,522,777) discloses a hand held device that when held against a can and pressed will drive a cutting edge or sharp edge into the can and will create a hole. Again, the device does not resemble a shotgun shell that is used to punch an air vent in a can of beer in order to "shotgun" the beer.

The King Patent Application Publication (U.S. Pub. No. 2006/0117577) discloses a metal can piercing tool in which the piercing head is located inside a sheath and the handle is pressed causing a spring to push the tool into the can. However, the tool is not useful in creating an air vent for use with a can of beer, and of which looks like a shotgun shell.

The Williams Patent (U.S. Pat. No. 7,503,120) discloses a small hand held cutting tool to be held between a person's fingers with a slidable cutting or puncturing head. Again, the cutting tool does not resemble a shotgun shell that is used to punch an air vent in a can of beer in order to "shotgun" the beer.

The Keys Patent (U.S. Pat. No. 2,390,309) discloses a hand held spring loaded aluminum or metal beverage container piercing tool in which the device is placed on the can and the handle is pressed, causing a sharp edge to puncture the side or the top of the can. Again, the tool does not resemble a shotgun shell that is used to punch an air vent in a can of beer in order to "shotgun" the beer.

The Scurto Patent (U.S. Pat. No. Des. 292,770) illustrates a design for a can piercing tool, which does not resemble a shotgun shell.

While the above-described devices fulfill their respective and particular objects and requirements, they do not describe an aluminum can puncturing device that is directed to use in puncturing an air vent in an aluminum can of beer for use in "shot-gunning" a can of beer or chugging the entire contents of said beer can; wherein the device resembles a shotgun shell and includes a spring-loaded pin for use in puncturing the can of beer. In this regard, the aluminum can puncturing device departs from the conventional concepts and designs of the prior art.

SUMMARY OF THE INVENTION

The aluminum can puncturing device is a hand-held device that resembles a shot gun shell and of which is capable of puncturing an air vent into a side of an aluminum can in order to "shotgun" a beer. The aluminum can puncturing device includes a spring-loaded pin that retracts within a shotgun shell. The aluminum can puncturing device is placed onto an outer surface of an aluminum can and pushed thereon in order to extend the pin out from under the shotgun shell in order to pierce a vent hole into the aluminum can.

It is an object of the invention to provide a device that can pierce a vent hole into an aluminum can.

A further object of the invention to provide an aluminum can puncturing device that resembles a shotgun shell.

A further object of the invention is to provide a pin that is spring-loaded, and of which rests in a retracted state within the main housing of the shotgun shell, and wherein the pin is spring-loaded such that the pin will retract after puncturing a vent hole into the aluminum can.

These together with additional objects, features and advantages of the aluminum can puncturing device will be readily apparent to those of ordinary skill in the art upon reading the following detailed description of presently preferred, but nonetheless illustrative, embodiments of the aluminum can puncturing device when taken in conjunction with the accompanying drawings.

In this respect, before explaining the current embodiments of the aluminum can puncturing device in detail, it is to be understood that the aluminum can puncturing device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the aluminum can puncturing device.

It is therefore important that the claims be regarded as including such equivalent construction insofar as they do not depart from the spirit and scope of the aluminum can puncturing device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
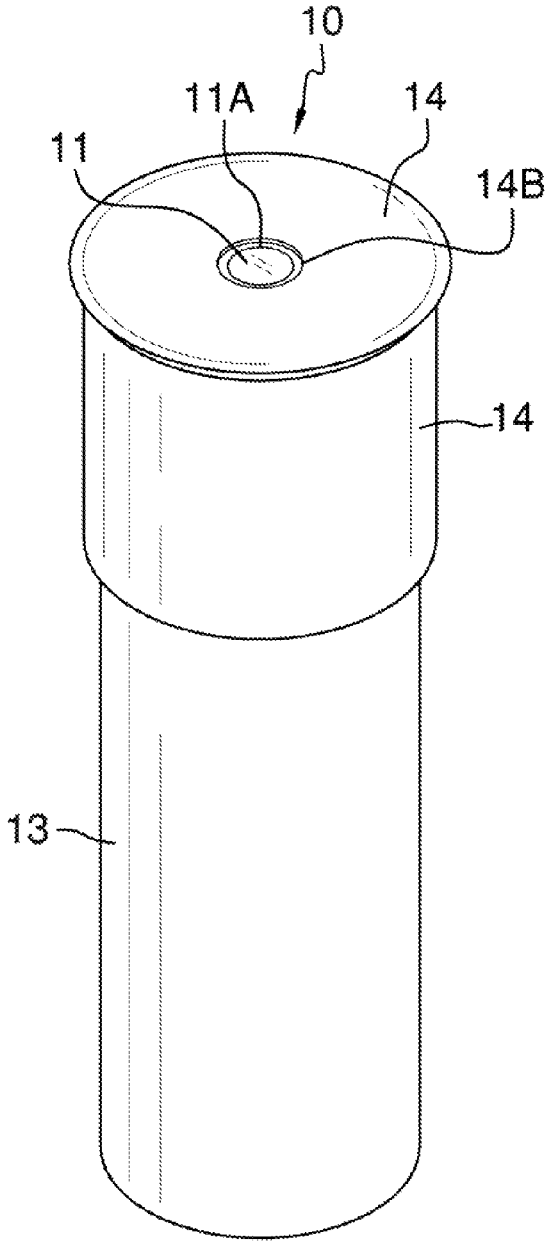
FIG. 1 illustrates a top, isometric view of the aluminum can puncturing device by itself with the spring-loaded pin retracted.
Figure 2:
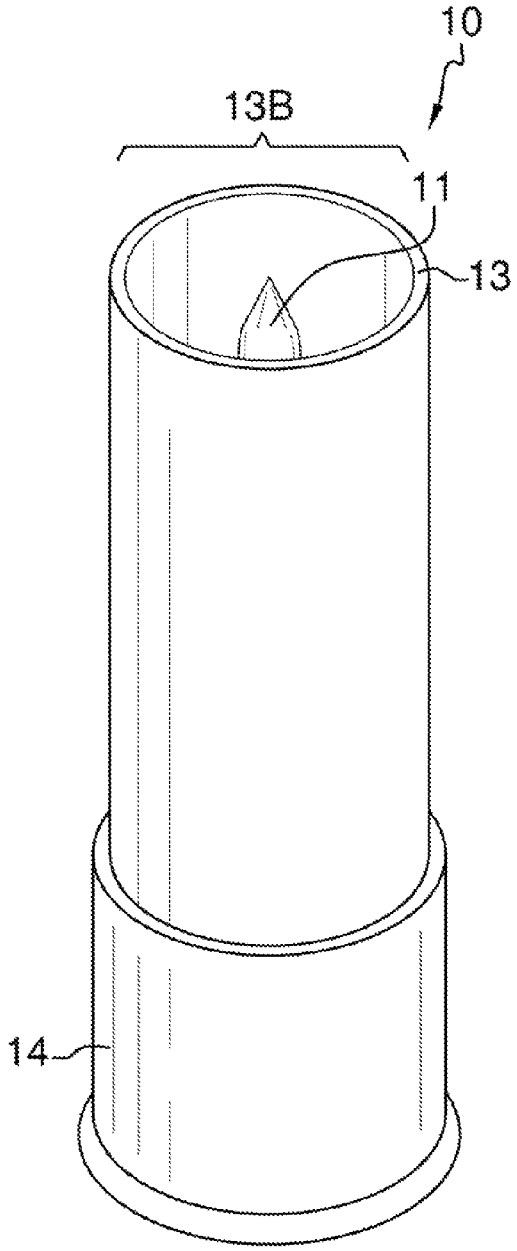
FIG. 2 illustrates a bottom, isometric view of the aluminum can puncturing device by itself and with the spring-loaded pin in a retracted state.
Figure 3:
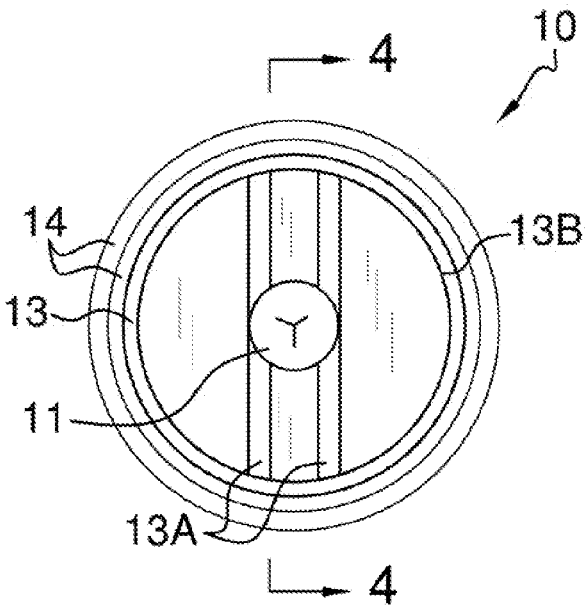
FIG. 3 illustrates a bottom view of the aluminum can puncturing device with the sway bar and pin being depicted about the center.
Figure 4:
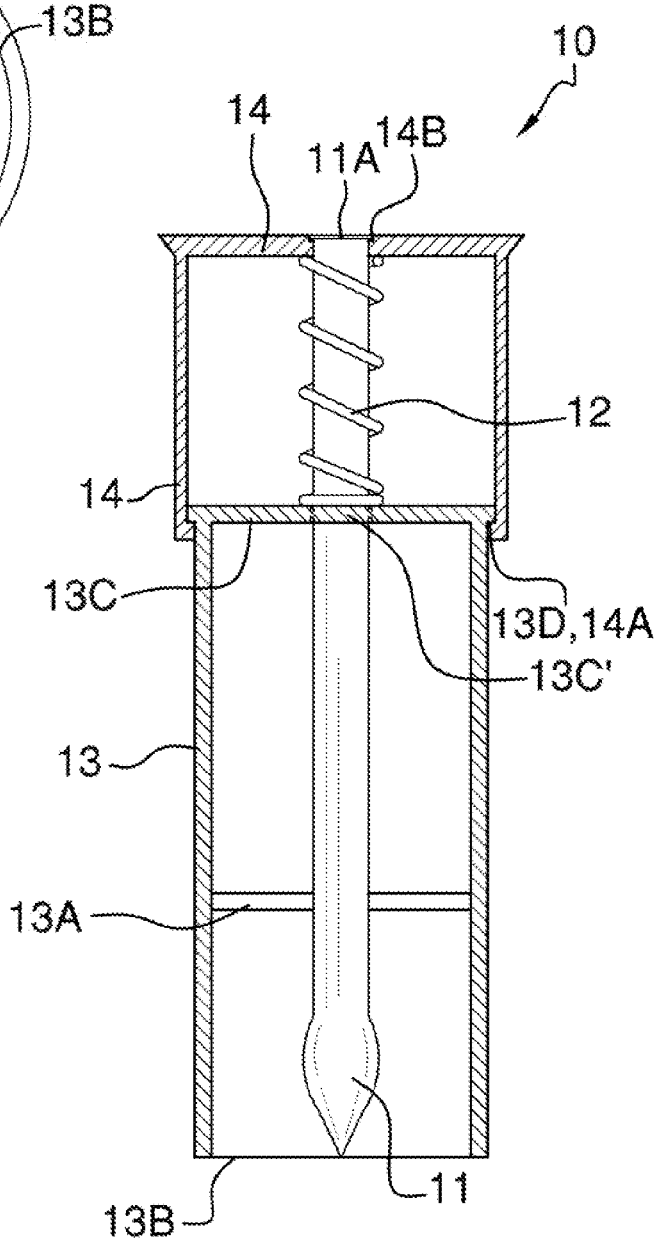
FIG. 4 illustrates a cross-sectional view of the aluminum can puncturing device along line 4-4 in FIG. 3 and detailing the inter-relation of the pin, sway bar, spring, top cal, and barrel.
Figure 5:
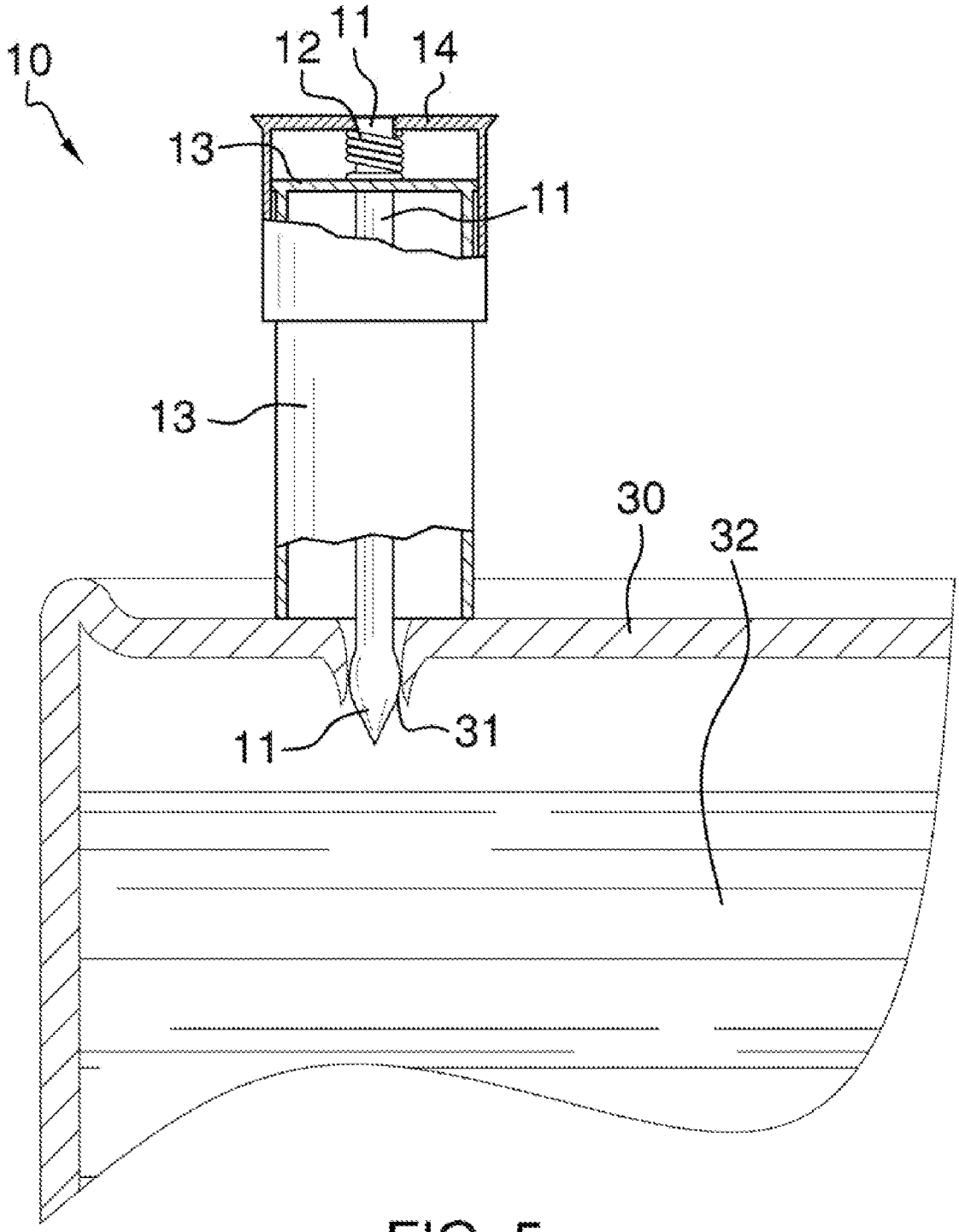
FIG. 5 illustrates a detailed, cut-away view of the aluminum can puncturing device in use with an aluminum can.

Detailed reference will now be made to the preferred embodiment of the present invention, examples of which are illustrated in FIGS. 1-5. An aluminum can puncturing device 10 (hereinafter invention) includes a pin 11, a spring 12, a barrel 13, and a brass cap 14.

The barrel 13 includes a sway bar 13A that is located within the barrel 13. The barrel 13 has a bottom opening 13B through which the pin 11 extends. The barrel 13 has a top 13C that contains a hole 13C' through which the pin 11 passes through.

Both the barrel 13 and the brass cap 14 are of hollow construction, and are designed to resemble a shotgun shell, which is well known in the art. The barrel 13 has an outer diameter less than the inner diameter of the brass cap 14, which enables the barrel 13 to retract within the brass cap 14. However, a portion of the barrel 13 can slide into the brass cap 14. The top 13C of the barrel 13 has a lip 13D that extends radially outwards from the barrel 13. The brass cap 14 has a lip 14A that extends inwardly, and acts as a stop when engaged upon by the lip 13D of the barrel 13.

The spring 12 is confined between both the brass cap 14 and the top 13C of the barrel 13. The spring 12 acts to bias the barrel 13 in an extended state with respect to the brass cap 14 (see FIGS. 1, 2, and 4). However, upon placement of the invention 10 against a surface and depressing force upon the brass cap 14 in a downward direction towards the barrel 13, the barrel 13 will retract into the brass cap 14 and reveal a portion of the pin 11 contained therein.

The brass cap 14 has a hole 14B located on a top, center surface of the brass cap 14. More particularly, the hole 14B has a step located thereon, which works to support the pin 11 mounted thereon. The pin 11 has a shoulder 11A that prevents the pin 11 from detaching from the brass cap 14.

The pin 11 is aligned and supported via the sway bar 13A, the hole 13C' of the top 13C of the barrel 13, and via the interaction between the shoulder 11A of the pin 11 and the hole 14B of the brass cap 14. The pin 11 is designed to extend from below the bottom opening 13B of the barrel 13, once the barrel 13 has been partially retracts within the brass cap 14. The pin 11 can pierce an air vent 31 into an aluminum can 30. The air vent 31 aids in consuming contents (more particularly, beer) 32 therein.

It shall be noted that the term "to shotgun a beer" means to consume a can of beer in as short a period of time as possible by creating the air vent 31 and opening the can 30 by a mouth (not depicted, but well known in the art). The air vent 31 prevents a vacuum from forming from within the aluminum can 30 and enables an end user to ingest the beer more quickly.

It shall be further noted that an inventive feature of the invention 10 is an aluminum can piercing device that resembles a shotgun shell and is used to pierce the aluminum can in order to form a vent hole prior to "shotgunning a beer."

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An aluminum can puncturing device comprising:

a barrel that attaches to and retracts partially within a brass cap;

wherein the barrel and the brass cap resemble a shotgun shell;

wherein a pin is mounted to said brass cap, such that upon partial retraction of the barrel, the pin is revealed and is used to puncture a vent hole in an aluminum can prior to opening said aluminum can in order to shotgun a beer;

wherein the barrel retracts partially within the brass cap via an outward lip located on the barrel that interacts with an inward lip located on the brass cap such that the interaction between the outward lip and the inward lip acts as a stop to prevent the separation of the barrel from the brass cap;

wherein the barrel has a top and a hole located in said top;

wherein the pin passes through said hole;

wherein a spring is contained within a compartment formed between the brass cap and the top of the barrel such that the barrel is fully extended when not in use.

2. The aluminum can puncturing device as described in claim 1 wherein the barrel includes a sway bar within the barrel to support and align the pin.

3. The aluminum can puncturing device as described in claim 1 wherein the brass cap has a hole with a step located on a top surface of the brass cap; wherein the pin has a collar that mounts the pin to said brass cap.

4. An aluminum can puncturing device comprising:

a barrel that attaches to and retracts partially within a brass cap;

wherein the barrel and the brass cap resemble a shotgun shell;

wherein the barrel has an outer diameter less than the inner diameter of the brass cap;

wherein a pin is mounted to said brass cap, such that upon partial retraction of the barrel, the pin is revealed and is used to puncture a vent hole in an aluminum can prior to opening said aluminum can in order to shotgun a beer;

wherein the barrel retracts partially within the brass cap via an outward lip located on the barrel that interacts with an inward lip located on the brass cap such that the interaction between the outward lip and the inward lip acts as a stop to prevent the separation of the barrel from the brass cap;

wherein the barrel has a top and a hole located in said top; wherein the pin passes through said hole;

wherein a spring is contained within a compartment formed between the brass cap and the top of the barrel such that the barrel is fully extended when not in use;

wherein the barrel includes a sway bar within the barrel to support and align the pin.

5. The aluminum can puncturing device as described in claim 4 wherein the brass cap has a hole with a step located on a top surface of the brass cap; wherein the pin has a collar that mounts the pin to said brass cap.

6. An aluminum can puncturing device comprising:

a barrel that attaches to and retracts partially within a brass cap;

wherein the barrel and the brass cap resemble a shotgun shell;

wherein the barrel and the brass cap are of hollow construction;

wherein the barrel has an outer diameter less than the inner diameter of the brass cap;

wherein a pin is mounted to said brass cap, such that upon partial retraction of the barrel, the pin is revealed and is used to puncture a vent hole in an aluminum can prior to opening said aluminum can in order to shotgun a beer;

wherein the barrel retracts partially within the brass cap via an outward lip located on the barrel that interacts with an inward lip located on the brass cap such that the interaction between the outward lip and the inward lip acts as a stop to prevent the separation of the barrel from the brass cap;

wherein the barrel has a top and a hole located in said top; wherein the pin passes through said hole;

wherein a spring is contained within a compartment formed between the brass cap and the top of the barrel such that the barrel is fully extended when not in use;

wherein the barrel includes a sway bar within the barrel to support and align the pin;

wherein the brass cap has a hole with a step located on a top surface of the brass cap; wherein the pin has a collar that mounts the pin to said brass cap.

* * * * *